US012471673B2

(12) United States Patent
Moon

(10) Patent No.: US 12,471,673 B2
(45) Date of Patent: Nov. 18, 2025

(54) INSOLE HAVING POSITION TRACKING FUNCTION

(71) Applicant: SMART MEDICAL DEVICE CO., LTD., Gyeonggi-do (KR)

(72) Inventor: Chan Gon Moon, Seoul (KR)

(73) Assignee: kokasin Co., Ltd., Gyeonggi-do (KR)

( * ) Notice: Subject to any disclaimer, the term of this patent is extended or adjusted under 35 U.S.C. 154(b) by 0 days.

(21) Appl. No.: 18/568,911

(22) PCT Filed: Aug. 23, 2022

(86) PCT No.: PCT/KR2022/095116
§ 371 (c)(1),
(2) Date: Dec. 11, 2023

(87) PCT Pub. No.: WO2023/153640
PCT Pub. Date: Aug. 17, 2023

(65) Prior Publication Data

US 2024/0268518 A1 Aug. 15, 2024

(30) Foreign Application Priority Data

Feb. 8, 2022 (KR) ..... 10-2022-0015962

(51) Int. Cl.
*A43B 17/00* (2006.01)
*A43B 3/40* (2022.01)
(Continued)

(52) U.S. Cl.
CPC ..... *A43B 17/00* (2013.01); *A43B 3/40* (2022.01); *A43B 3/46* (2022.01); *A43B 3/48* (2022.01)

(58) Field of Classification Search
CPC .. A43B 17/00; A43B 3/38; A43B 3/34; A43B 3/46; A43B 3/48; A43B 3/50
(Continued)

(56) References Cited

U.S. PATENT DOCUMENTS

2009/0224908 A1* 9/2009 Rastegar ..... A43B 7/00 36/103
2011/0094127 A1* 4/2011 Dana, III ..... A43B 3/36 36/137
(Continued)

FOREIGN PATENT DOCUMENTS

JP 2019-217182 A 12/2019
JP 3230237 U 1/2021
(Continued)

OTHER PUBLICATIONS

International Search Report from corresponding PCT Application No. PCT/KR2022/095116, dated Dec. 2, 2022.
(Continued)

*Primary Examiner* — Timothy K Trieu
(74) *Attorney, Agent, or Firm* — Harness, Dickey & Pierce, P.L.C.

(57) ABSTRACT

An insole having a position tracking function according to an embodiment of the present invention includes: an insole body including a ball of the foot support part which supports the front part of the sole and a heel support part which supports the rear part of the sole; a GPS antenna for receiving a GPS signal; a mobile communication antenna for transmitting or receiving a mobile communication signal; a wireless charging coil for wirelessly receiving power; and a position tracking part connected to the GPS antenna and the mobile communication antenna to perform a position tracking function, wherein the GPS antenna is seated on the ball of the foot support part of the insole body and a container is seated on the heel support part of the insole body.

7 Claims, 11 Drawing Sheets

(51) Int. Cl.
*A43B 3/46* (2022.01)
*A43B 3/48* (2022.01)

(58) Field of Classification Search
USPC ..... 36/43
See application file for complete search history.

(56) References Cited

U.S. PATENT DOCUMENTS

| | | | | |
|---|---|---|---|---|
| 2015/0048942 | A1 | 2/2015 | Bertagna et al. | |
| 2015/0068070 | A1 | 3/2015 | Moss | |
| 2016/0250099 | A1* | 9/2016 | Eim | A61H 39/04 36/141 |
| 2023/0148701 | A1* | 5/2023 | Stevens | H02J 50/80 307/104 |

FOREIGN PATENT DOCUMENTS

| | | | |
|---|---|---|---|
| KR | 10-1115495 | B1 | 3/2012 |
| KR | 10-2016-0136090 | A | 11/2016 |
| KR | 10-2017-0112955 | A | 10/2017 |
| KR | 10-2018-0052179 | A | 5/2018 |
| KR | 10-1901739 | B1 | 9/2018 |
| KR | 10-2021-0051425 | A | 5/2021 |
| WO | WO-2020/195371 | A1 | 10/2020 |

OTHER PUBLICATIONS

Office Action from corresponding Japanese Patent Application No. 202-575732, dated Oct. 1, 2024.

* cited by examiner

120A

120B

INSOLE HAVING POSITION TRACKING FUNCTION

This application is a national phase application of PCT Application No. PCT/KR2022/095116, filed on Aug. 23, 2022, which claims priority to Korean Patent Application No. 10-2022-0015962, filed on Feb. 8, 2022. The entire disclosures of the applications identified in this paragraph are incorporated herein by references.

TECHNICAL FIELD

The present invention relates to an insole placed in a shoe for use, and more specifically, to an insole equipped with a GPS module and a mobile communication module, enabling position tracking.

BACKGROUND ART

Research and development project related to this invention are as follows.

[R&D project supporting the present invention]

[Project series number] H2121003

[Department name] Gyeonggi-do

[Research management agency] Gyeonggido Business and Science Accelerator

[Research project name] Business-led general practice

[Research project name] Development of an insole-type low-power positioning sensor communication module based on the next-generation IoT network LTE-Cat.m1

[Host research institute] Smart Medical Devices Co., Ltd.

[Research period] 07.01, 2021-02.11, 2022

People who lack the discernment of a normal adult, such as children, individuals with intellectual disabilities, or elderly individuals with dementia, as well as pets or important items, such as valuables, may be at risk of going missing or being lost while the guardian or owner momentarily diverts their attention. Therefore, there has long been a demand for methods to prevent the loss or disappearance of such protected entities.

The oldest and still most widely used method is to write the contact information of the guardian or item owner on the entity. For example, it is a common practice to write a parent's phone number on children's bracelets or necklaces or to write the owner's contact information on a bag. However, this method has the drawback of being ineffective until someone notices it and helps, and there is also a potential risk of the information being misused for criminal purposes.

Recently, a method utilizing electronic devices has emerged, involving real-time tracking of the entity's location using global positioning system (GPS) and mobile communication networks (3G, LTE, etc.). This involves using GPS to locate the current position of the entity and periodically transmitting the located position to the server via a mobile communication network. For example, attaching a GPS location tracking device to a child and, in the event of a loss, the GPS location tracking device transmits the location to a server through the mobile communication network. However, this method requires a user to subscribe separately to the communication network, incurring communication network usage costs. Additionally, the device attached to the child requires a GPS module and a wireless communication module for mobile communication network use, making it expensive and less portable. Moreover, due to high power consumption, the device increases in size and requires frequent battery charging, which incurs inconveniences in many ways, including cost and convenience.

Furthermore, if a location tracking device is attached to items such as bracelets or necklaces as in the conventional method, there is an issue with elderly people with dementia or children easily removing the bracelet or necklace. Particularly in the case of elderly people with dementia, who tend to remove items worn on the body, such as bracelets, necklaces, or jewelry, it may be ultimately impossible to achieve the location tracking function.

DETAILED DESCRIPTION OF THE INVENTION

Technical Problem

An object to be achieved by the present invention is to provide an insole with a position tracking function that includes a device for real-time tracking of a user's position.

Technical Solution

According to an embodiment of the present invention to achieve the above object, an insole having a position tracking function includes: an insole body including a forefoot support part which supports the front part of the sole and a heel support part which supports the rear part of the sole; a GPS antenna for receiving a GPS signal; a mobile communication antenna for transmitting or receiving a mobile communication signal; a wireless charging coil for wirelessly receiving power; and a position tracking part connected to the GPS antenna and the mobile communication antenna to perform a position tracking function, wherein the position tracking part includes a wireless communication module configured to perform signal processing for the GPS signal and the mobile communication signal; a position information processing module configured to process position information according to the GPS signal or the mobile communication signal; a power supply module including a battery charged with power supplied through the wireless charging coil and configured to provide the power charged in the battery to the wireless communication module and the position information processing module; a memory configured to store control information for an operation of the position information processing module; and a container having the wireless communication module, the position information processing module, the power supply module, and the memory mounted therein, the GPS antenna is seated on the forefoot support part of the insole body, and a container is seated on the heel support part of the insole body.

The GPS antenna may be vertically seated on a plate shape of the forefoot support part.

The GPS antenna may be spaced within a predetermined range of distance from a front end of the forefoot support part.

The GPS antenna may have a curvature of an arch shape corresponding to the front end of the forefoot support part that has an arch shape.

The mobile communication antenna may be vertically seated on a side surface of the container.

The mobile communication antenna may be divided into two parts, including a first mobile communication antenna and a second mobile communication antenna, and the first mobile communication antenna and the second mobile communication antenna may be spaced apart from each other by a predetermined distance.

The first mobile communication antenna may have a larger surface area compared to the second mobile communication antenna, the first mobile communication antenna may be connected to a ground, and the second mobile communication antenna may transmit and receive the mobile communication signal.

The wireless charging coil may be seated on the forefoot support part of the insole body.

The container may consist of a container cover and a container body, and the container cover and the container body may be coupled to each other using a waterproof ring.

Advantageous Effects

According to the present invention, an insole for a shoe that is small, lightweight, easily powered, and highly portable is provided, allowing real-time tracking of the location of a user such as an elderly person with dementia, a child, or a person with intellectual disabilities.

In particular, by placing a GPS antenna at the front of the insole and the mobile communication antenna at the back, it is ensured that the insole can fully perform its function of absorbing shock on the foot while facilitating the transmission and reception of GPS signals and mobile communication signals.

MODE FOR INVENTION

Figure 1A:
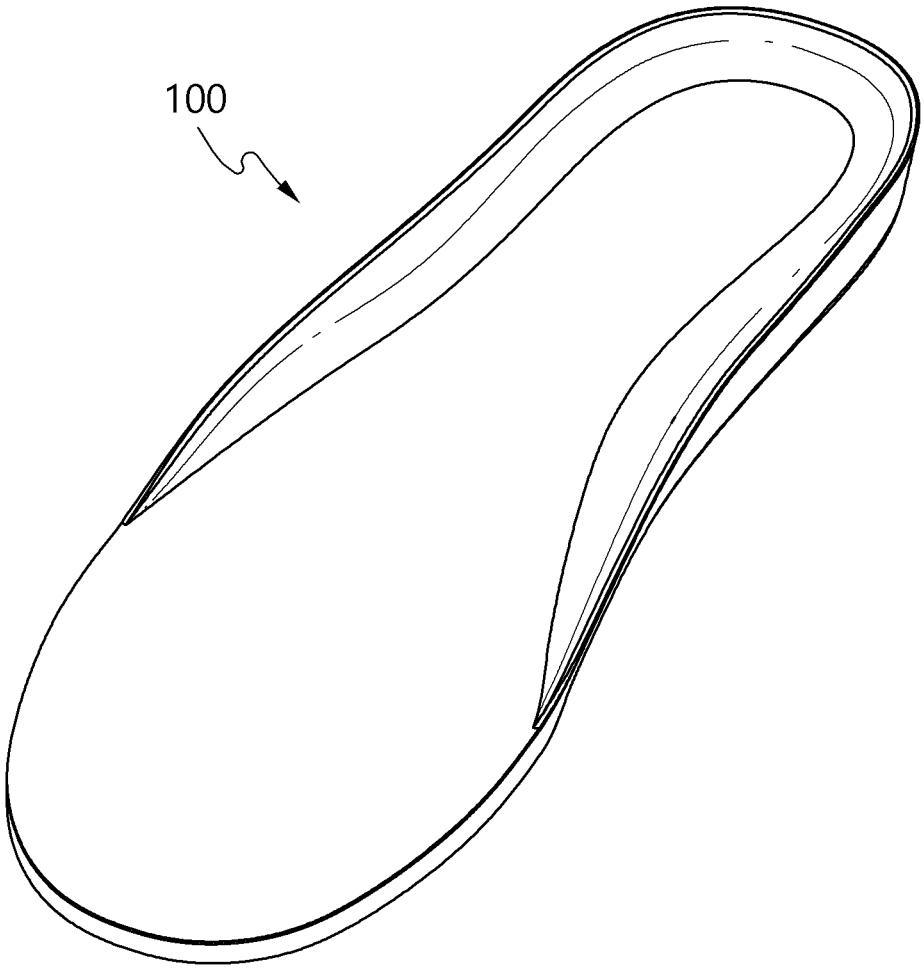
FIG. 1A is a top perspective view illustrating an insole having a position tracking function of the present invention.

Hereinafter, exemplary embodiments of the present invention will be described in detail with reference to the drawings. In the following descriptions and accompanying drawings, like reference numerals substantially refer to like elements, and as a result, a duplicated description will be omitted. Further, in the description of the present invention, detailed descriptions of related well-known functions or configurations that are determined to unnecessarily obscure the gist of the present invention will be omitted.

Hereinafter, embodiments of the present invention will be described in detail with reference to the accompanying drawings.

Figure 1B:
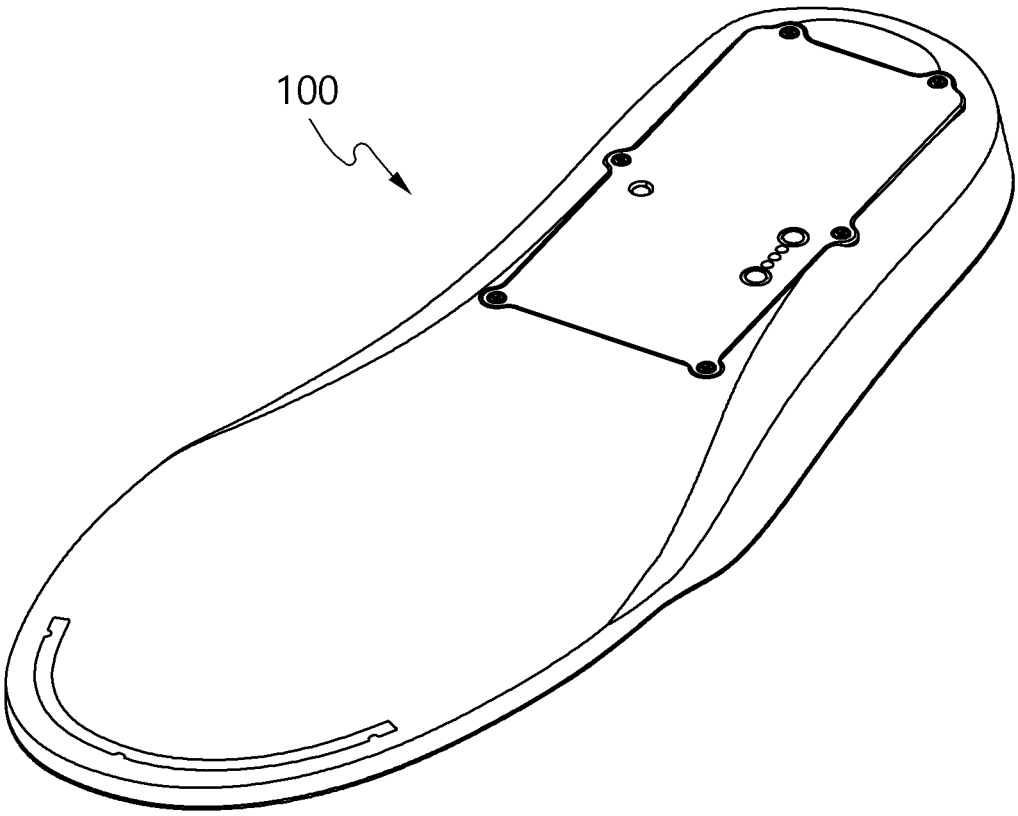
FIG. 1B is a bottom perspective view illustrating the insole having a position tracking function shown in FIG. 1A.

FIG. 1A is a top perspective view illustrating an insole 100 having a position tracking function of the present invention, and FIG. 1B is a bottom perspective view illustrating the insole 100 having a position tracking function shown in FIG. 1A.

The insole 100 having a position tracking function of the present invention includes an insole body, a global positioning system (GPS) antenna, a mobile communication antenna, a wireless charging coil, and a position tracking part.

Figure 2A:
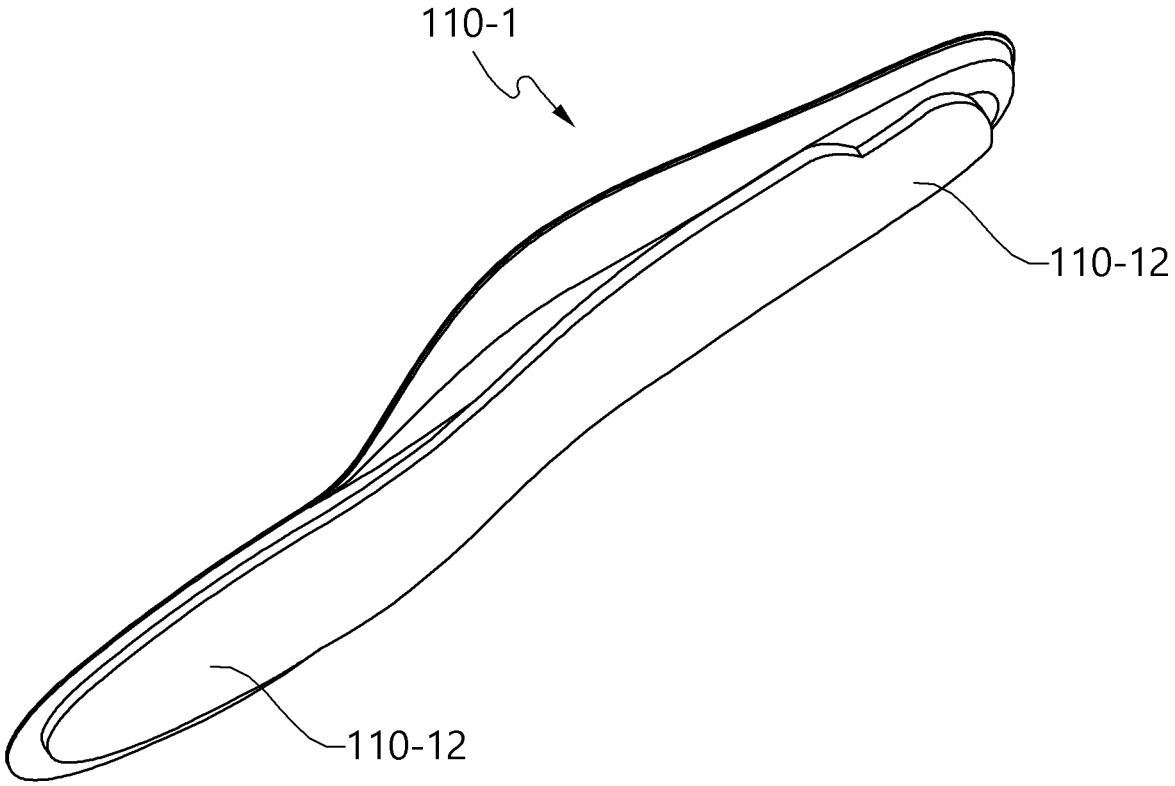
FIGS. 2A and 2B are structural views showing an insole body among the components of the insole.
Figure 2B:
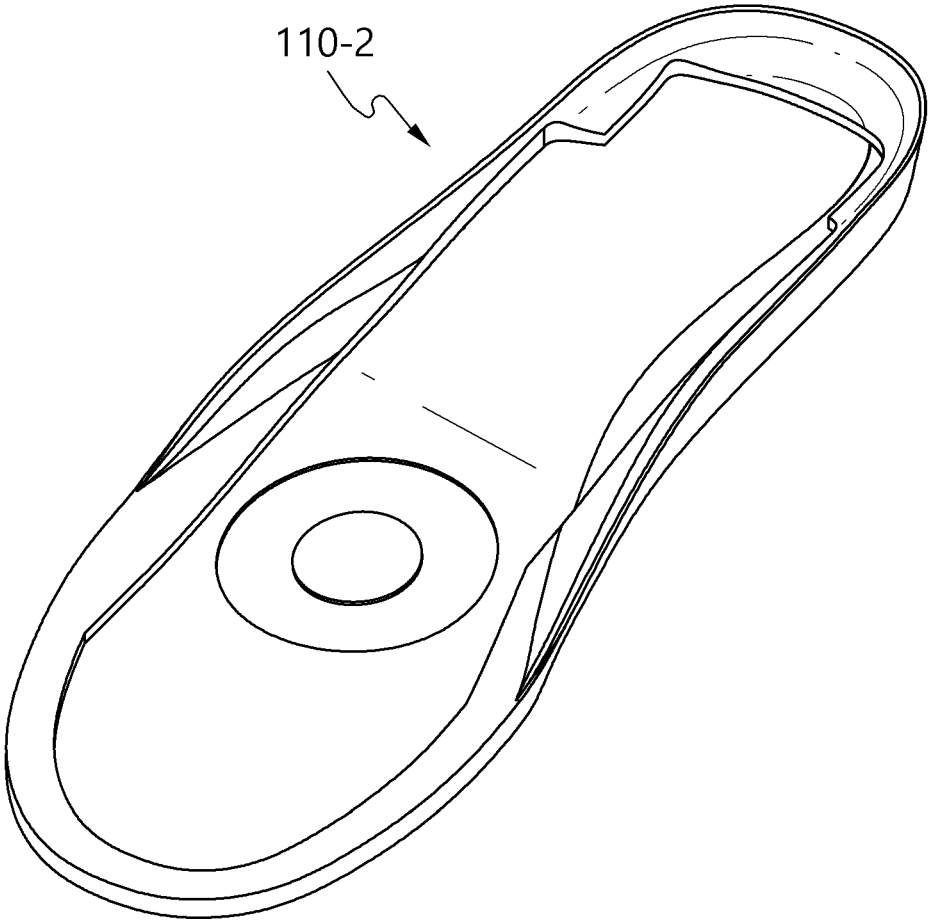

FIGS. 2A and 2B are structural views showing an insole body 110 among the components of the insole 100.

The insole body 110 is inserted into a shoe, having a shape corresponding to the sole of the foot to provide support and cushioning for the foot. The insole body 110 includes an upper cover 110-1 and a lower cover 110-2.

An upper surface of the upper cover 110-1 is the part in contact with the sole of the foot, having a shape corresponding to the sole of the foot. A lower surface of the upper cover 110-1 has a structure that surrounds the lower cover 110-2.

The upper cover 110-1 includes a forefoot support part 110-11 corresponding to the front part of the sole shape and a heel support part 110-12 corresponding to the rear part of the sole shape. The forefoot support part 110-11 is the part of the insole that supports the front part of the sole, while the heel support part 110-12 is the part of the insole that supports the rear part of the sole.

The lower cover 110-2 has a shape corresponding to the sole of the foot and, when combined with the upper cover 110-1, may accommodate the GPS antenna, the mobile communication antenna, the wireless charging coil, and the position tracking part.

The GPS antenna, the mobile communication antenna, the wireless charging coil, and the position tracking part may be disposed between the upper cover 110-1 and the lower cover 110-2 of the insole body 110 or may be inserted and arranged within the lower cover 110-2. However, for the convenience of explanation, the placement relationship of the GPS antenna, the mobile communication antenna, the wireless charging coil, and the position tracking part is described with reference to the upper cover 110-1.

Figure 3A:
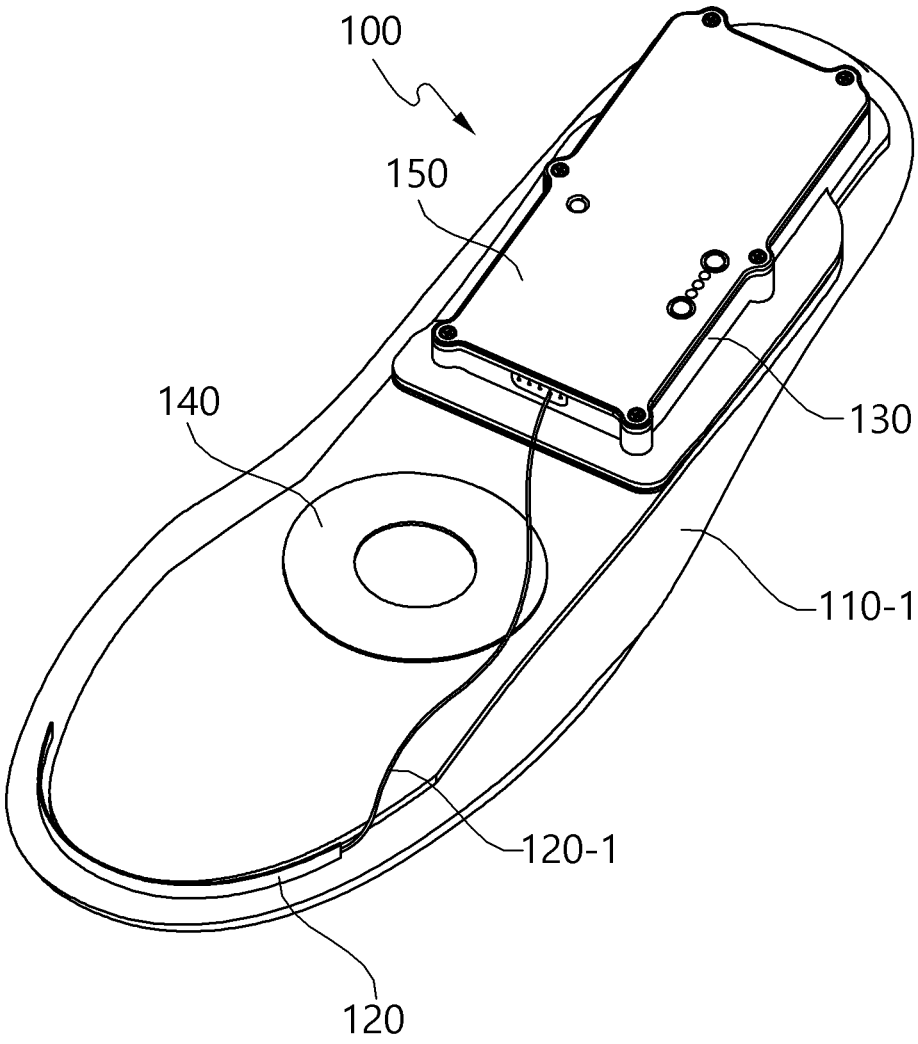
FIG. 3A is a reference view illustrating a GPS antenna, a mobile communication antenna, a wireless charging coil, and a position tracking part disposed on a lower surface of an upper cover.
Figure 3B:
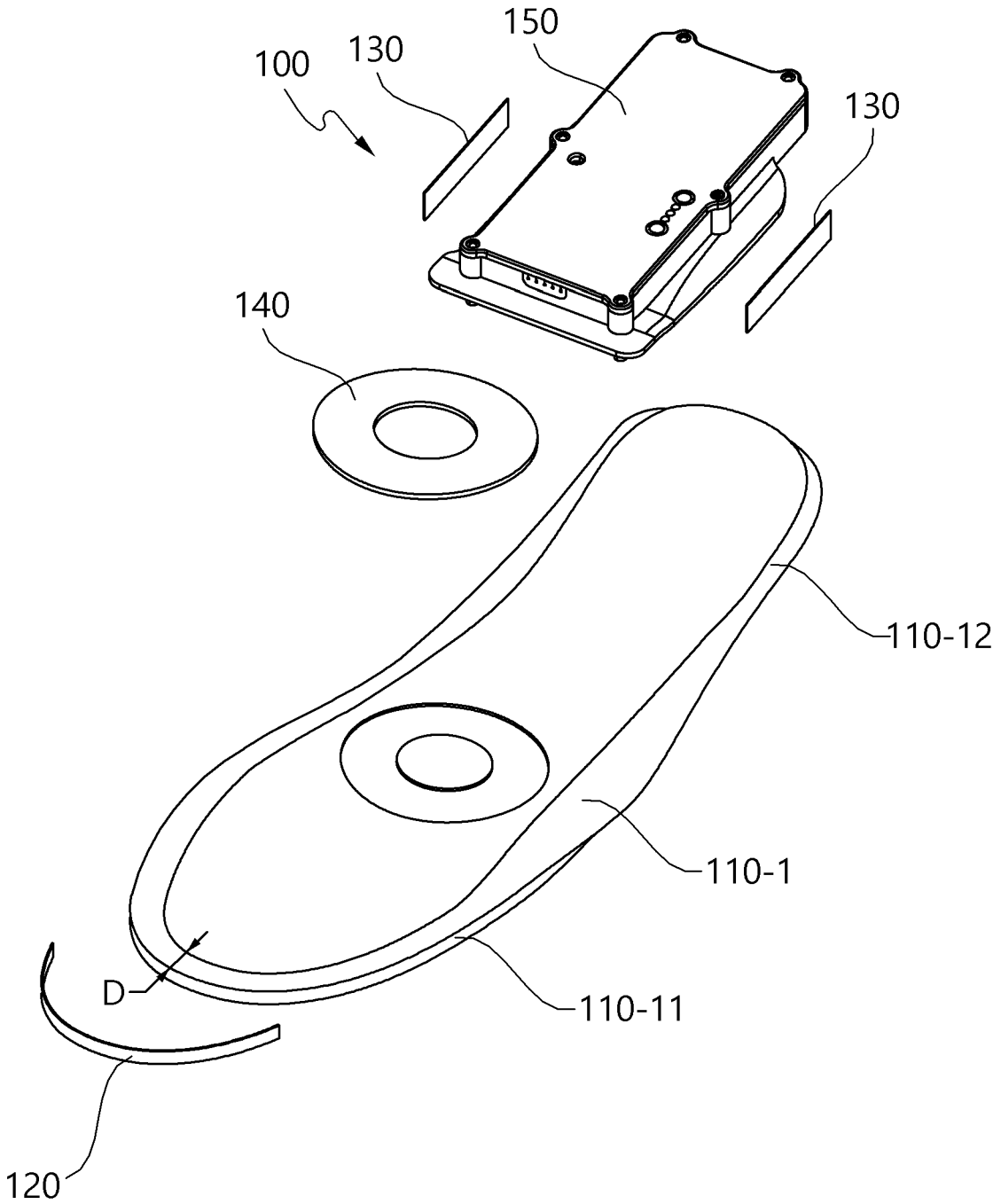
FIG. 3B is a reference view showing each component of FIG. 3A separated from the insole.

FIG. 3A is a reference view illustrating the GPS antenna 120, the mobile communication antenna 130, the wireless charging coil 140, and the position tracking part 150 disposed on the lower surface of the upper cover 110-1. FIG. 3B is a reference view showing each component of FIG. 3A separated from the insole.

The GPS antenna 120 and the wireless charging coil 140 may be positioned on the forefoot support part 110-11 of the upper cover 110-1. Additionally, the mobile communication antenna 130 and the position tracking part 150 may be disposed on the heel support part 110-12 of the upper cover 110-1.

In addition, although not illustrated, the GPS antenna 120 and the wireless charging coil 140 may be disposed on a forefoot support part (not shown) of the lower cover 110-2, and the mobile communication antenna 130 and the position tracking part 150 may be disposed on a heel support part (not shown) of the lower cover 110-2.

The GPS antenna 120 receives GPS signals from satellites and transmits the received GPS signals to the position tracking part 150. For this purpose, the GPS antenna 120 is electrically connected via a cable 120-1 to the position tracking part 150.

As described above, the GPS antenna 120 may be disposed on the forefoot support part 110-11 of the upper cover 110-1. Specifically, the GPS antenna 120 may be vertically disposed on the plate shape of the forefoot support part 110-11 of the upper cover 110-1.

When the GPS antenna 120 is positioned on the plate shape of the anterior arch support 110-11 of the upper cover 110-1, the surface of the GPS antenna 120 may be surface-protected by a film or an elastic synthetic resin material.

Figure 4A:
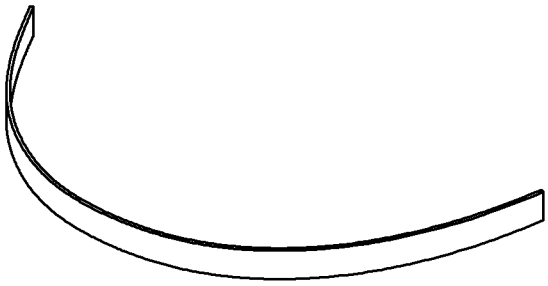
FIGS. 4A and 4B are reference diagrams illustrating the shape of a GPS antenna.
Figure 4B:
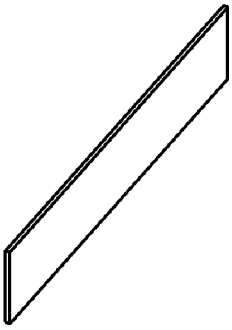

FIGS. 4A and 4B are reference diagrams illustrating the shape of the GPS antenna 120. As shown in FIGS. 4A and 4B, the GPS antenna 120 may be straight in the form of a plate-shaped bar or preferably have a curved shape in the form of a circular arc.

The GPS antenna 120 is spaced within a predetermined range of distance from the front end of the forefoot support part 110-11. For example, as shown in FIG. 3B, the GPS antenna 120 may be spaced within a predetermined range of distance D from the edge corresponding to the front end of the forefoot support part 110-11. Here, the predetermined distance D may be 3 [mm] or greater to 10 [mm] or less. In addition, the GPS antenna 120 is spaced within a predetermined range of distance from the front end of the forefoot support part 110-11, wherein if the front end of the forefoot support part 110-11 is configured in an arch shape, the shape of the GPS antenna 120 may be formed with a curvature corresponding to the shape of the front end of the forefoot support part 110-11.

The mobile communication antenna 130 may receive or transmit mobile communication signals. The mobile communication antenna 130 receives mobile communication signals from a mobile terminal and transmits the received mobile signals to the position tracking part 150. Additionally, the mobile communication antenna 130 may transmit mobile communication signals related to the position tracking of the position tracking part 150 to the mobile terminal. For this purpose, the mobile communication antenna 130 is electrically connected to the position tracking part 150.

As shown in FIG. 3B, the mobile communication antenna 130 may be vertically seated on a side surface of a container of the position tracking part 150. In this case, multiple mobile communication antennas 130 may be provided, symmetrically arranged on both sides of the container of the position tracking part 150. The mobile communication antenna 130 may be coupled to one side of a container wing member 150-521 of a container body 150-52.

The mobile communication antenna 130 may have a straight plate shape, but its shape may be variously modified.

Figure 5A:
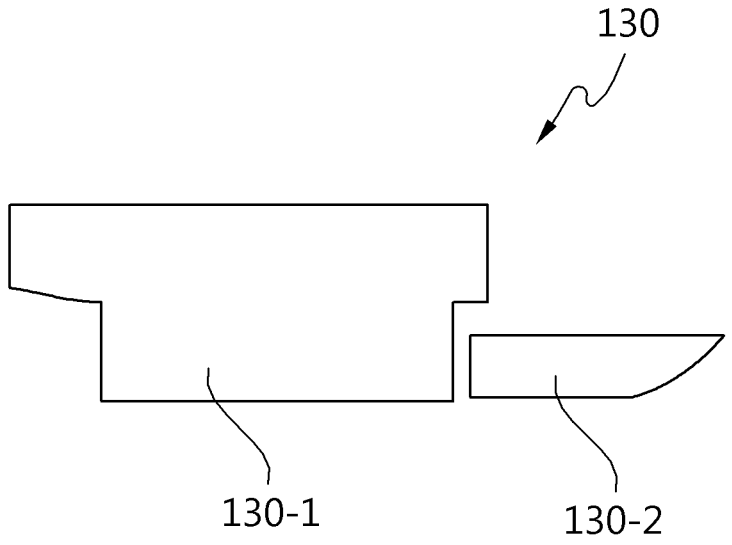
FIGS. 5A and 5B are reference diagrams illustrating the shape of a mobile communication antenna (130).
Figure 5B:
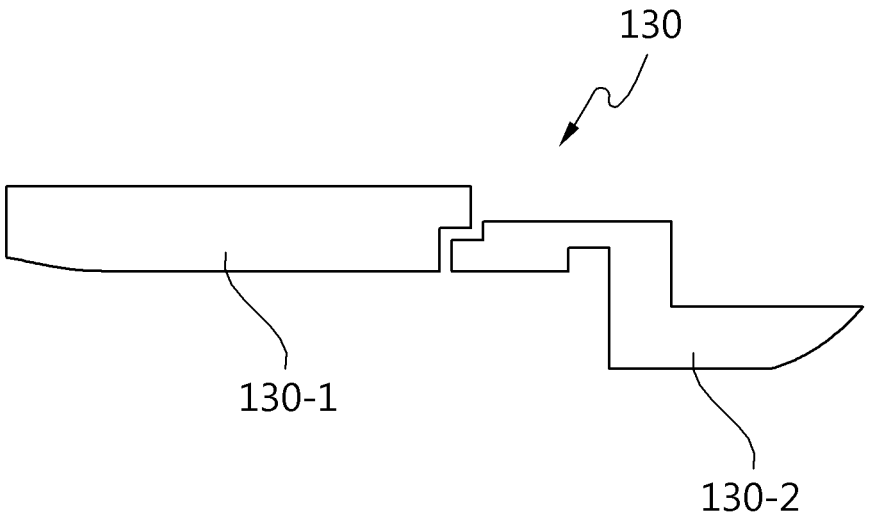

FIGS. 5A and 5B are reference diagrams illustrating the shape of a mobile communication antenna 130. As shown in FIGS. 5A and 5B, the mobile communication antenna 130 may be divided into two parts, including a first mobile communication antenna 130-1 and a second mobile communication antenna 130-2.

The first mobile communication antenna 130-1 and the second mobile communication antenna 130-2 are spaced apart by a predetermined distance. The separation distance may be determined by considering the frequency characteristics.

The first mobile communication antenna 130-1 is characterized by having a larger surface area compared to the second mobile communication antenna 130-2. The first mobile communication antenna 130-1 is connected to the ground, and the second mobile communication antenna 130-2 is responsible for transmitting and receiving mobile communication signals. The second mobile communication antenna 130-2 may have a stick shape with one end having a peak shape for transmitting and receiving mobile communication signals, and a portion of the stick shape may be bent.

The wireless charging coil 140 is seated on a plate forming the forefoot support part 110-11 of the upper cover 110-1 to wirelessly receive commercial power through an adapter. The wireless charging coil 140 is electrically connected to the position tracking part 150, providing the power supplied through the adapter to the position tracking part 150.

The position tracking part 150 is connected to each of the GPS antenna 120 and the mobile communication antenna 130 and performs the position tracking function. The position tracking part 150 may be seated on the rear part of the heel support part 110-12 of the upper cover 110-1.

Figure 6:
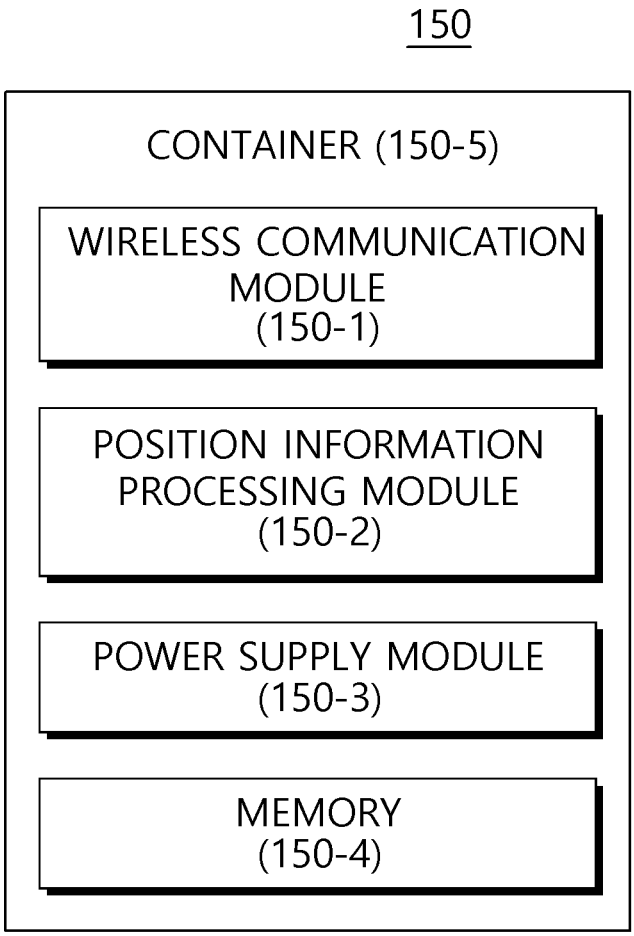
FIG. 6 is a functional block diagram to explain detailed components of the position tracking part.

FIG. 6 is a functional block diagram to explain detailed components of the position tracking part.

Referring to FIG. 6, the position tracking part 150 includes a wireless communication module 150-1, a position information processing module 150-2, a power supply module 150-3, a memory 150-4, and a container 150-5.

The wireless communication module 150-1 is electrically connected to the GPS antenna 120 and the mobile communication antenna 130 through cables or patterning methods and performs signal processing for GPS signals or mobile communication signals.

The position information processing module 150-2 processes the position information based on the GPS signals or mobile communication signals received through the wireless communication module 150-1. The position information processing module 150-2 may include a USB port, a UART port, and a JTAG port.

The position information processing module 150-2 may calculate position information from the GPS signals received by the GPS antenna 120 from GPS satellites, stores it in the built-in memory 150-4, generates a position information message in the form of short message service (SMS) or data communication, and transmits the position information message to a mobile communication base station through the mobile communication antenna 130.

The GPS satellite signals received through the GPS antenna 120 are converted into longitude, latitude, and altitude information by the position information processing module 150-2 through signal processing. The position information processing module 150-2 processes the information into the data format suitable for the communication method of the mobile carrier which a position information transmission device accesses, and stores the current position information in memory at regular time intervals.

The position information, stored in the memory 150-4 at regular intervals, is aggregated on a daily basis by the position information processing module 150-2 and processed into route movement information, and in a wireless communication block, frequency conversion and filtering are performed on the position information to align with the wireless communication frequency band of the mobile carrier. Subsequently, frequency modulation takes place in a wireless communication modem, and the processed information is transmitted through the mobile communication antenna 130.

For example, when a connection request signal is received through the mobile communication antenna 130 to a predesignated mobile communication number, communication connection setup occurs. When a signal requesting current position information is received, frequency demodulation takes place in a tri-band wireless communication modem and frequency filtering and conversion take place in the wireless communication block. Then, the most recent data among the position information stored in the memory 150-4 at 30-minute intervals is read and processed, frequency conversion and filtering are carried out in the wireless communication block, and frequency modulation occurs in the wireless communication modem. Thereafter, the processed data is transmitted through the mobile communication antenna 130. Upon receiving a signal, it is determined whether the received signal is a GPS signal or a mobile communication signal. If it is determined that the received signal is a GPS signal, the position and time information are verified and stored at 30-minute intervals. To transmit daily route movement information, it is determined whether 24 hours have passed; if not, signal reception is awaited again. In addition, if the received signal is a mobile communication signal, it is determined whether the signal corresponds to a position information request. If the signal corresponds to the location information request, the destination information is confirmed, the location and time information are read from memory and an SMS message or data is generated and transmitted to the mobile communication base station. If the received mobile communication signal is a communication sensitivity control signal for communication between the mobile communication base station and the position information transmission device, reception is awaited after adjusting the transmission strength by controlling the transmission power based on the signal strength of the received signal.

The position information processing module 150-2 sets a time value, and if the user's location remains unchanged for a period exceeding the set time value or if the user's state, detected by a biometric signal sensor, indicates an urgent biometric signal, the position information processing module 150-2 primarily transmits the status inquiry of the user to the user's mobile device via the wireless communication module 150-1. If there is no response from the mobile device for a predetermined period, the location information processing module 150-2 may be configured to automatically transmit a rescue request, including position information, to an emergency center such as 119. Alternatively, at the user's request, it may secondarily transmit a rescue request signal to the emergency center.

The power supply module 150-3 includes a battery (not shown) charged with power supplied through the wireless charging coil 140 and supplies the charged power to the wireless communication module 150-1 or the position information processing module 150-2. In addition to being connected to the wireless charging coil 140, the power supply module 150-3 may be equipped with a separate charging terminal for wired power charging.

The insole 100 may include a piezoelectric element that generates electricity through the force applied by the user's foot. Also, the insole 100 may include a biometric signal sensor to detect the user's biometric signals, measure the biometric signals of the user, and transmit the measured biometric signals to an external electronic device via the wireless communication module 150-1. For example, as a battery that primarily stores the electricity generated in the piezoelectric element and then supplies the electricity to the wireless communication module 150-1 and/or the position information processing module 150-2, a wire battery that can be deformed in shape is preferable.

Generally, batteries have a fixed square or circular shape, and installing a conventional battery into a shoe with a limited volume as in the present invention may impose size limitations, making it difficult to meet power capacity demands when using a small-sized battery. Therefore, it is preferably to use a wire battery in the present invention, which can be flexibly shaped, such as bent, allowing for freedom in its installation in various areas.

The wire battery may be formed in the insole or outer cover of the shoe, and it may be integrated into a shoelace or wrapped around the inner perimeter of the shoe. Alternatively, the sewing thread of the shoe may be used as the wire battery.

The wire battery may be coated with synthetic resin to prevent damage from external impact, and the coating of the wire battery may be made waterproof to prevent the wire battery from short-circuiting or corroding due to external moisture, thus preventing the lifespan of the wire battery from being shortened.

The memory 150-4 stores control information for the operation of the position information processing module 150-2. In addition, the memory 150-4 stores position information corresponding to the processing result of the position information processing module 150-2.

The wireless communication module 150-1, the position information processing module 150-2, the power supply module 150-3, and the memory 150-4 are mounted in the container 150-5.

Figure 7A:
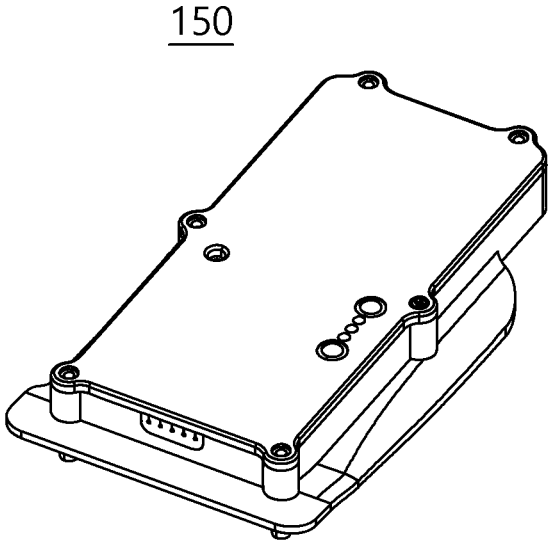
FIG. 7A is a reference view illustrating a front portion of a container.
Figure 7B:
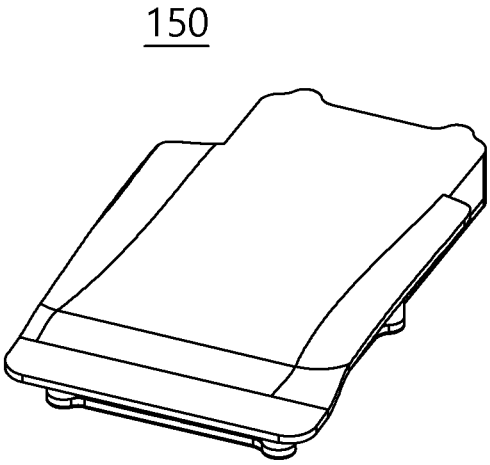
FIG. 7B is a reference view illustrating a rear portion of the container.
Figure 7C:
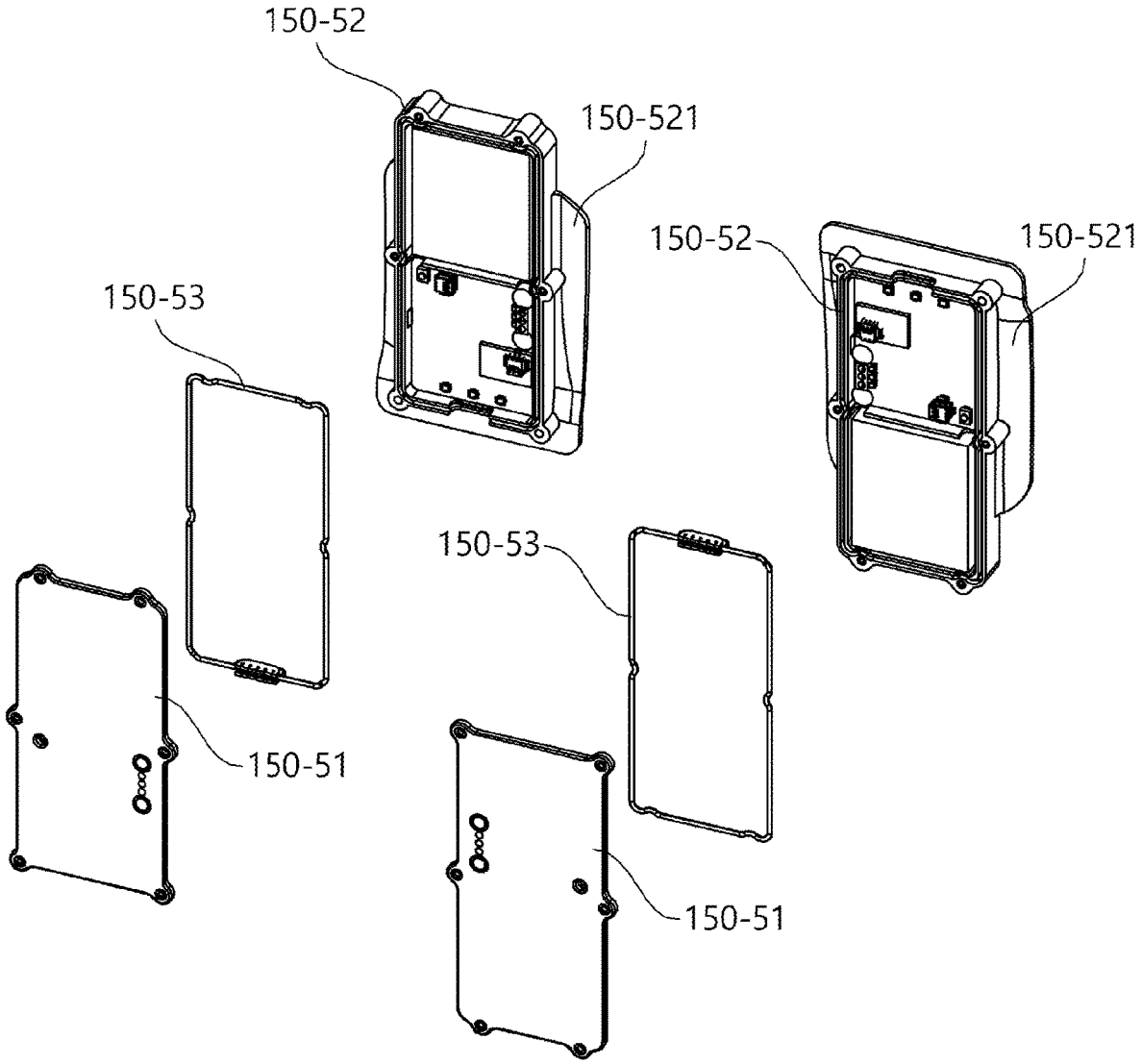
FIG. 7C is an exploded perspective view of the container.

FIG. 7A is a reference view illustrating a front portion of the container 150-5, FIG. 7B is a reference view illustrating a rear portion of the container 150-5, and FIG. 7C is an exploded perspective view of the container 150-5.

Referring to FIG. 7C, the container 150-5 includes a container cover 150-51, a container body 150-52, and a waterproof ring 150-53.

The wireless communication module 150-1, the position information processing module 150-2, the power supply module 150-3, and the memory 150-4 are seated in the container body 150-52, and the container body 150-52 is covered with the container cover 150-51.

The container body 150-52 includes a container wing member 150-521 extending to both upper lateral surfaces of the body. The mobile communication antenna 130 may be coupled to one side of the container wing member 150-521.

When the container cover 150-51 and the container body 150-52 are coupled, the waterproof ring 150-53 may be inserted and coupled between the container cover 150-51 and the container body 150-52. The material of the waterproof ring 150-53 may be silicone.

A number of exemplary embodiments have been particularly shown and described with reference to certain exemplary embodiments thereof. It will be understood by one of ordinary skill in the art that various changes in form and details may be made therein without departing from the spirit and scope of the exemplary embodiments as defined by the following claims. The exemplary embodiments should be considered in a descriptive sense only and not for purposes of limitation. Therefore, the scope of the exemplary embodiments is defined not by the detailed description of the exemplary embodiments but by the following claims, and all differences within the scope will be construed as being included in the exemplary embodiments.

What is claimed is:

1. An insole having a position tracking function, comprising:

an insole body including a forefoot support part configured to support a front part of a sole of user's foot and a heel support part configured to support a rear part of the sole of user's foot;

a global positioning system (GPS) antenna for receiving a GPS signal;

a mobile communication antenna for transmitting or receiving a mobile communication signal;

a wireless charging coil for wirelessly receiving power; and a position tracking part connected to the GPS antenna and the mobile communication antenna to perform a position tracking function, wherein the position tracking part comprises:

a wireless communication module configured to perform signal processing for the GPS signal and the mobile communication signal;

a position information processing module configured to process position information according to the GPS signal or the mobile communication signal;

a power supply module including a battery charged with power supplied through the wireless charging coil and configured to provide the power charged in the battery to the wireless communication module and the position information processing module;

a memory configured to store control information for an operation of the position information processing module; and a container having the wireless communication module, the position information processing module, the power supply module, and the memory mounted therein, the GPS antenna is seated on the forefoot support part of the insole body, and a container is seated on the heel support part of the insole body;

wherein the mobile communication antenna is vertically seated on a side surface of the container, and wherein the mobile communication antenna is divided into two parts, including a first mobile communication antenna and a second mobile communication antenna, and the first mobile communication antenna and the second mobile communication antenna are spaced apart from each other by a predetermined distance.

2. The insole of claim 1, wherein the GPS antenna is vertically seated on a plate shape of the forefoot support part.

3. The insole of claim 1, wherein the GPS antenna is spaced within a predetermined range of distance from a front end of the forefoot support part.

4. The insole of claim 3, wherein the GPS antenna has a curvature of an arch shape corresponding to the front end of the forefoot support part that has an arch shape.

5. The insole of claim 1, wherein the first mobile communication antenna has a larger surface area compared to the second mobile communication antenna, the first mobile communication antenna is connected to a ground, and the second mobile communication antenna transmits and receives the mobile communication signal.

6. The insole of claim 1, wherein the wireless charging coil is seated on the forefoot support part of the insole body.

7. The insole of claim 1, wherein the container consists of a container cover and a container body, and the container cover and the container body are coupled to each other using a waterproof ring.

* * * * *